US005632696A

United States Patent [19]

Nichols et al.

[11] Patent Number: 5,632,696

[45] Date of Patent: May 27, 1997

[54] GOLF TEE SETTER

[76] Inventors: W. S. Nichols, 18 Cecil Dr.; A. J. Cortez, 33 Lake Dr., both of Woodville, Tex. 75979; Stanley Simon, Rt. 4, Box 1176, Colmesneil, Tex. 75938

[21] Appl. No.: 543,635

[22] Filed: Oct. 16, 1995

[51] Int. Cl.[6] ..... A63B 57/00

[52] U.S. Cl. ..... 473/386

[58] Field of Search ..... 473/386

[56] References Cited

U.S. PATENT DOCUMENTS

| | | | |
|---|---|---|---|
| 4,616,826 | 10/1986 | Trefts | 473/386 X |
| 4,714,250 | 12/1987 | Henthorn | 473/386 X |
| 4,819,938 | 4/1989 | Hill | 473/386 X |
| 4,951,947 | 8/1990 | Koplfe | 473/386 X |
| 5,080,357 | 1/1992 | Wolf | 473/386 X |
| 5,171,010 | 12/1992 | Lanoue | 473/386 X |
| 5,205,598 | 4/1993 | Miller | 473/386 X |
| 5,330,177 | 7/1994 | Rogge | 473/386 |
| 5,330,178 | 7/1994 | Geishert, Sr. | 473/386 |

*Primary Examiner*—William H. Grieb
*Attorney, Agent, or Firm*—David H. Judson

[57] ABSTRACT

The present invention comprises a golf tee setting apparatus including a handle enabling the user to maneuver and apply pressure to a golf ball and tee for placement in the ground, a casing defining a ball chamber for receiving a golf ball and a tee gripping mechanism for retaining a golf ball and tee within the ball chamber. The handle is connected to the casing and to the gripping apparatus via an extension member allowing a user to place a golf ball within the ground while remaining in a substantial upright position. An actuation means connected between the tee gripping mechanism and the handle enables the user to move the tee gripping mechanism between the gripping and non-gripping positions.

11 Claims, 2 Drawing Sheets

GOLF TEE SETTER

TECHNICAL FIELD

The invention relates to golf apparatus, and more particularly, to a new and improved golf tee setting apparatus wherein the same is arranged for the ease of directing a golf ball and tee into the ground.

BACKGROUND ON THE INVENTION

Many golfers have physical restrictions due to injuries, diseases, replacements, etc. relating to their back, spine, hip and other body regions that severely limit or prevent their teeing the ball for play in the usual manner. These golfers may require the assistance of another person to properly tee the golf ball for play.

Various apparatus have been devised in the past to assist such golfers in teeing the golf ball in the ground in readiness for play without the golfer's having to physically bend/stoop over at the waist or to kneel to do so. However, each of these suffer from various limitations.

SUMMARY OF INVENTION

The present invention overcomes the foregoing and other problems with a golf tee setting apparatus. The device comprises a casing defining a chamber for containing a golf ball. A tee gripping mechanism encloses the lower end of the chamber and defines a means for gripping a golf tee such that a golf ball is maintained within the chamber between the top of the chamber and a gripped golf tee. The gripping mechanism includes a pair of tee holders slidably connected to move in a horizontal direction with respect to the casing. The tee holders are actuated by a first and second pairs of arms connected between the slides and an actuation means.

The actuation means normally comprises a bar or chain connected to a pull-ting running along an extension arm connecting the casing and tee gripping mechanism to a handle. By pulling on the pull-ring located near the handle, the bar or chain actuates the tee gripping mechanism to move between the gripping and non-gripping positions. When the slides are in a non-gripping position, a ball and tee may be placed within the casing chamber and tee-gripping mechanism or a presently gripped ball and tee placed in the ground may be released.

The foregoing has outlined some of the more pertinent aspects of the present invention. These aspects should be construed to be merely illustrative of some the more prominent features and applications of the invention. Many other beneficial results can be obtained by applying the disclosed invention in a different manner or modifying the invention as will be described. Accordingly, other aspects and a fuller understanding of the invention may be had by referring to the following detailed description of the preferred embodiment.

BRIEF DESCRIPTIONS OF THE DRAWINGS

For a more complete understanding of the present invention and the advantages thereof, reference should be made to the accompanying drawings in which.

DETAILED DESCRIPTION

Figure 1:
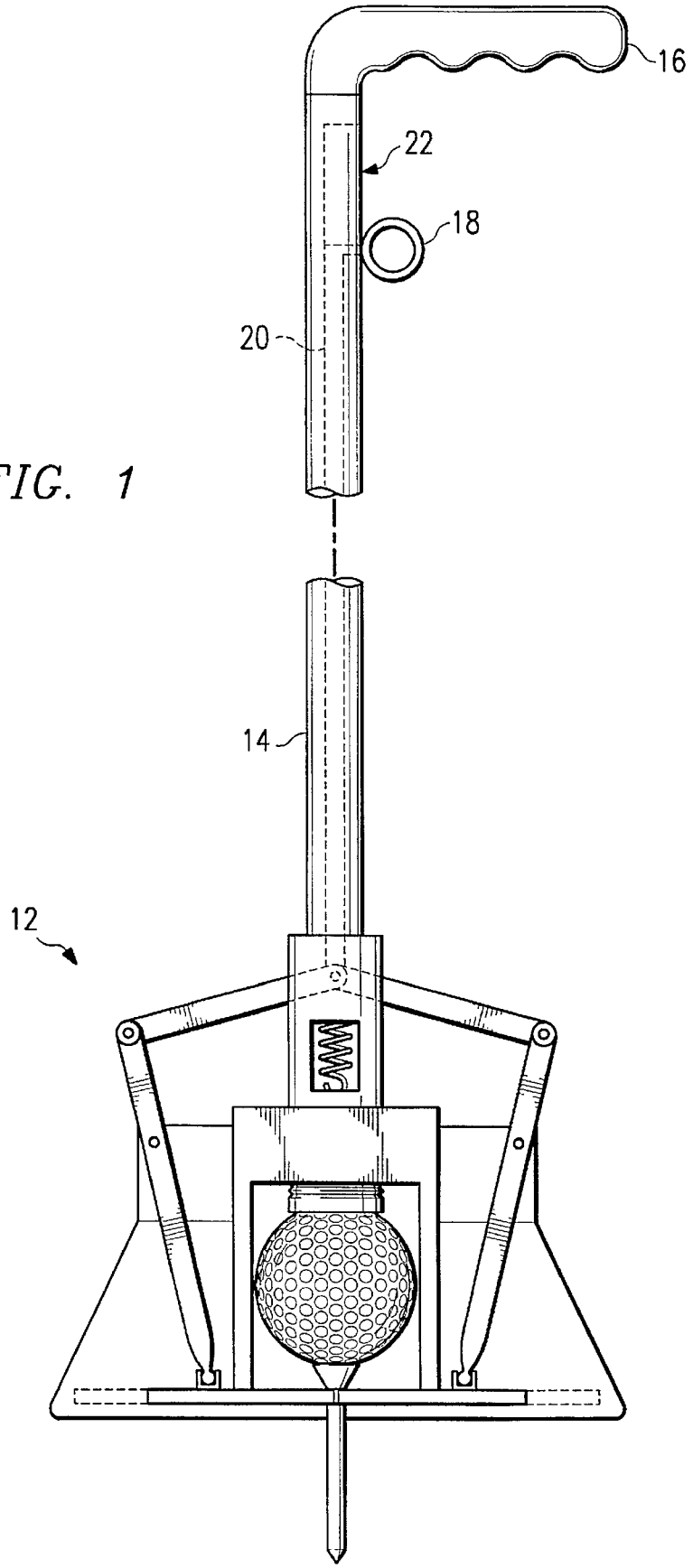
FIG. 1 is a side view of the golf tee setter apparatus of the present invention.

Referring now to the drawings, and more particularly to FIG. 1, there is illustrated a side view of the golf tee setter apparatus of the present invention. The apparatus consists of a ball and tee setting mechanism 12 mounted to an extension pole 14 and handle 16. A pull-ring 18 actuates the ball and tee setting mechanism 12 to open to receive or release a golf ball and tee. The pull-ring 18 is connected to the upper end of an actuation rod 20 running within the interior of extension pole 14. The pull-ring 18 moves up and down along a slot 22 defined in the outer surface of extension pole 14.

Figure 2:
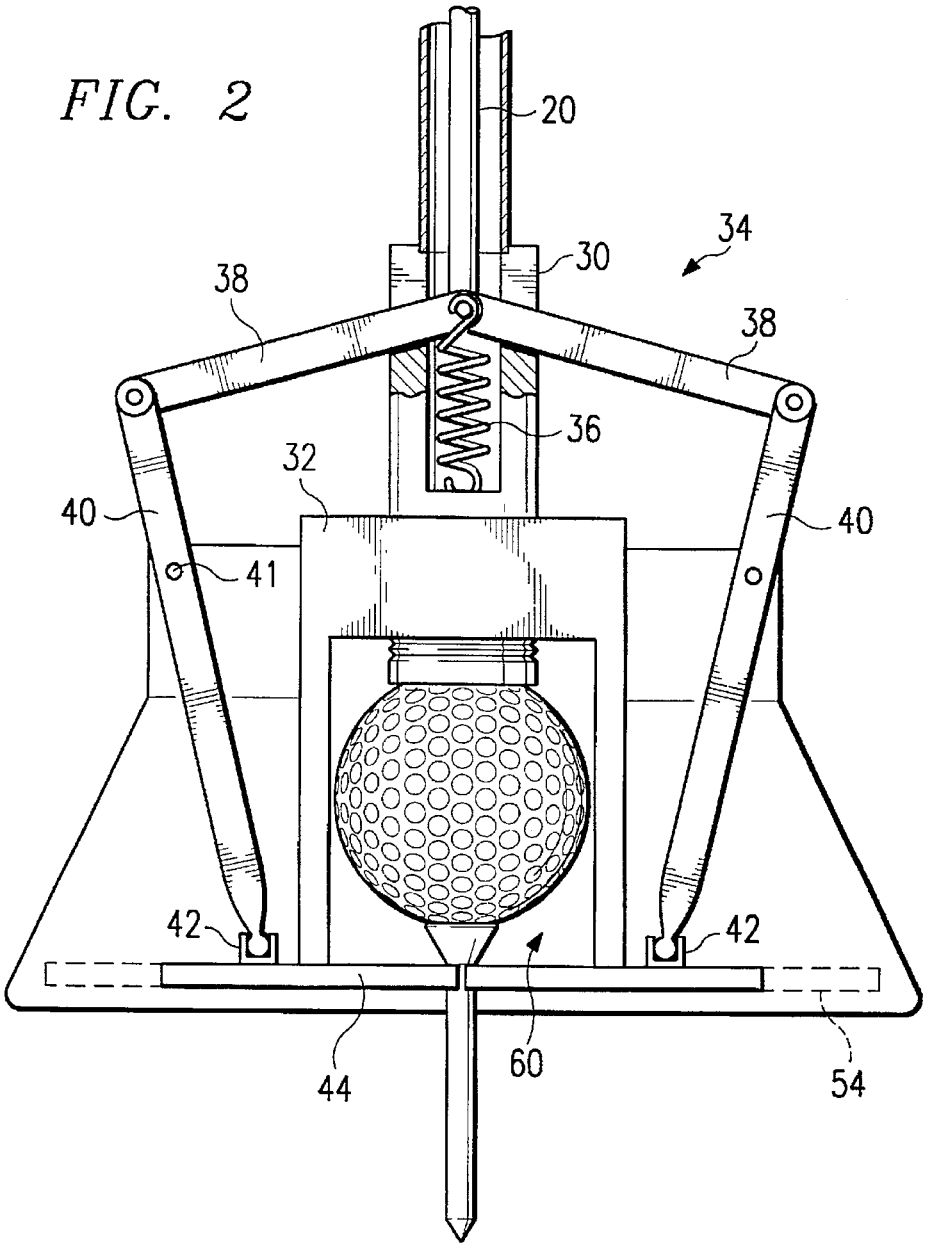
FIG. 2 is a side view of the tee gripping mechanism.

Referring now to FIG. 2, there is illustrated a side view of the ball and tee setting mechanism 12. The ball and tee setting mechanism 12 consists of an adjustment cylinder 30, ball casing 32 and tee gripping mechanism 34. The adjustment cylinder 30 threadedly engages the ball casing 32 enabling the tension of a spring 36 to be adjusted as desired. The spring 36 is connected at a first end to the interior of the ball casing 32 and at a second end to a point wherein the tee gripping mechanism 34 and actuation rod 20 are connected. The adjustment cylinder 30 rotates to adjust the bias to spring 36 as desired.

The tee gripping mechanism 34 consists of a first pair of arms 38 and second pair of arms 40. The first pair of arms are connected from the actuation rod 20 and spring 36 to the second arms 40. The second arms 40 are pivotally connected to the ball casing 32. One end of the second arms 40 engage a channel 42 defined by the tee holders 44 which will be more fully described in a moment, and the other ends are pivotally connected to the first arms 38.

Figure 3:
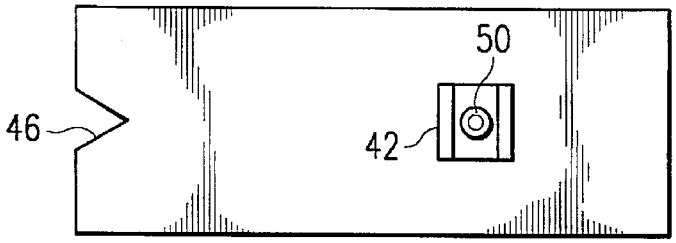
FIG. 3 is a top view of the tee holder of the tee gripping mechanism.

Referring now also to FIG. 3, there are illustrated the tee holders 44 of the tee gripping mechanism 34. The tee holder 44 comprises a rectangular piece having a slot 46 cut in one end thereof for engaging a golf tee. Connected to the top side of the tee holder 44 is a U-shaped channel 42 for actuating movement of the tee holder 44. The U-shaped channel 42 is connected to the tee holder 44 by means of a rivet 50 or other well known type of connection means. While the preferred embodiment disclose the use of a U- shaped channel, any means capable of receiving an end of the second arms 40 to actuate movement of the tee holder 44 would be acceptable. Referring now again to FIG. 2, the tee holders 44 move in a horizontal direction as defined by guide slots 54 within the ball casing 32. Movement from a gripping to a non-gripping position is actuated by movement of second arms 40 about their pivot points.

The golf tee setter of the present invention will function in the following manner. Initially, the tee holders 44 are in the position illustrated in FIG. 2. When the pull-ring 18 is pulled toward handle 16, actuation rod 20 pulls spring 36 and the first ends of first arms 38 upward causing second arms 40 to pivot about their pivot points 41. As the second arms 40 pivot about their pivot points, the tee slides 44 are forced open in a horizontal direction along slots 54 to enable placement of a golf ball and tee within chamber 60. When the ball and golf tee are in place, the pressure on pull-ring 18 may be released, and the bias of spring 36 returns the tee holders 44 to the closed position to grip a golf tee. Thus, the ball and tee are firmly held within chamber 60. The player may then force the golf tee into the ground to a desired depth by pushing down with handle 16. When a desired tee depth is achieved, the pull-ting 18 is again pulled to release the grip on the golf tee in the manners previously described. The ball and tee remain in the ground while the golf tee setter may be removed and stored until required again.

It should be appreciated by those skilled in the art that the specific embodiments disclosed above may be readily utilizes the basis for modifying or designing other structures for carrying out the purposes of the present invention. It should also be realized by those skilled in the art that such equivalent constructions do not depart from the spirit and scope of the invention as set forth in the appended claims.

We claim:

1. A golf tee setter, comprising;

a handle enabling a user to maneuver and apply pressure to a golf ball and a tee;

a casing defining a ball chamber for retaining the golf ball;

a pair of holders slidably connected to the casing to move in a horizontal direction with respect to the casing for securing the tee in a substantially immovable position such that the tee maintains the golf ball in the ball chamber of the casing, the pair of holders defining an opening for receiving the tee;

an extension member connecting the handle to the casing and the tee gripping mechanism for enabling placement of the golf ball and tee by a user in a substantially upright position; and means for actuating the tee gripping mechanism between a gripping and a non-gripping position.

2. The golf tee setter of claim 1 wherein the tee gripping mechanism further comprises:

means for moving the pair of holders between the gripping and the non-gripping positions in response to the means for actuating; and means for biasing the pair of holders to the gripping position.

3. The golf tee setter of claim 2 wherein the means for biasing comprises a spring, the spring having a first end connected to the means for actuating and the means for moving and a second end connected to the casing.

4. The golf tee setter of claim 2 wherein the means for moving further includes:

a first pair of members pivotally connected between first ends and second ends to the casing, the first ends connected to the pair of holders; and a second pair of members having first ends connected to the second ends of the first pair of members and second ends connected with the means for actuating.

5. The golf tee setter of claim 2 further including means for adjusting the bias of the means for biasing.

6. The golf tee setter of claim 1 wherein the means for actuating comprises:

a pull-ring located near the handle; and a bar having a first end connected to the pull-ring and a second end connected to the tee gripping mechanism such that when the pull-ring is pulled upward the gripping mechanism moves from the gripping to the non-gripping position and when the pull-ring is released the gripping mechanism moves from the non-gripping to the gripping position.

7. A golf tee setter, comprising;

a handle enabling a user to maneuver and apply pressure to a golf ball and a tee;

a casing defining a ball chamber for retaining the golf ball;

a pair of holders slidably connected to the casing to move in a horizontal direction with respect to the casing for securing the tee in a substantially immovable position such that the tee maintains the golf ball in the ball chamber of the casing, the pair of holders defining an opening for receiving the tee;

means for actuating the pair of holders between a gripping and a non-gripping position;

a first pair of members responsive to the means for actuating, pivotally connected between first ends and second ends to the casing for moving the pair of holders between the gripping and the non-gripping positions responsive to the means for actuating, the first ends of the first pairs of members connected with the pair of holders;

a second pair of members having first ends connected to the second ends of the first pair of members and second ends connected with the means for actuating;

means for biasing the pair of holders to the gripping position; and an extension member connecting the handle to the casing for enabling placement of the golf ball and tee by a user in a substantially upright position.

8. The golf tee setter of claim 7 wherein the means for biasing comprises a spring, the spring having a first end connected to the means for actuating and the means for moving and a second end connected to the casing.

9. The golf tee setter of claim 7 further including means for adjusting the bias of the means for biasing.

10. The golf tee setter of claim 7 wherein the means for actuating comprises:

a pull-ring located substantially near the handle; and a bar having a first end connected to the pull-ring and a second end connected to the tee gripping mechanism such that when the pull-ring is pulled upward the gripping mechanism moves from the gripping to the non-gripping position and when the pull-ring is released the gripping mechanism moves from the non-gripping to the gripping position.

11. A golf tee setter, comprising;

a casing defining a ball chamber for retaining a golf ball;

a pair of holders slidably connected to the casing to move in a horizontal direction with respect to the casing for securing a golf tee in a substantially immonable position such that the golf tee maintains the golf ball in the ball cnanber of the casing, the pair of holkers defining an opening for receiving the golf tee;

means for actuating the pair of holders between a gripping and a non-gripping position abour the golf tee; and a handle enabling placement of the golf ball and the golf tee.

* * * * *